US009937504B2

(12) United States Patent
Dillard, Jr. et al.

(10) Patent No.: US 9,937,504 B2
(45) Date of Patent: Apr. 10, 2018

(54) INDUSTRIAL SHREDDER

(71) Applicants: Thomas C. Dillard, Jr., Grand Prairie, TX (US); Matthew Morrison, Grand Prairie, TX (US)

(72) Inventors: Thomas C. Dillard, Jr., Grand Prairie, TX (US); Matthew Morrison, Grand Prairie, TX (US)

(73) Assignee: Granutech-Saturn Systems Corp., Grand Prairie, TX (US)

( * ) Notice: Subject to any disclaimer, the term of this patent is extended or adjusted under 35 U.S.C. 154(b) by 667 days.

(21) Appl. No.: 14/226,301

(22) Filed: Mar. 26, 2014

(65) Prior Publication Data

US 2015/0273479 A1 Oct. 1, 2015

(51) Int. Cl.

| | |
|---|---|
| ***B02C 25/00*** | (2006.01) |
| ***B02C 18/24*** | (2006.01) |
| ***B02C 18/14*** | (2006.01) |

(52) U.S. Cl.

CPC ..... *B02C 25/00* (2013.01); *B02C 18/142* (2013.01); *B02C 18/24* (2013.01)

(58) Field of Classification Search

CPC ..... B02C 25/00; B02C 18/142; B02C 18/24
See application file for complete search history.

(56) References Cited

U.S. PATENT DOCUMENTS 4,034,918 A * 7/1977 Culbertson ..... B02C 18/0084 241/236
4,452,400 A * 6/1984 Williams ..... B02C 18/24 241/236
4,793,561 A * 12/1988 Burda ..... B02C 18/24 241/101.2
5,285,973 A * 2/1994 Goforth ..... B02C 18/182 241/236
6,027,179 A * 2/2000 Arai ..... B60T 1/005 180/306
7,588,206 B2 9/2009 Hausman et al.
2003/0230083 A1* 12/2003 Dorscht ..... F15B 11/028 60/443
2007/0215222 A1* 9/2007 Rauch ..... F15B 13/0438 137/625.62
2009/0065258 A1* 3/2009 Hamilton ..... E21B 7/068 175/61
2009/0152384 A1* 6/2009 Kolbet ..... B02C 21/026 241/101.741
2010/0162693 A1* 7/2010 Michael ..... C10M 171/02 60/327
2012/0006920 A1* 1/2012 Weidman ..... B02C 18/0007 241/36

* cited by examiner

*Primary Examiner* — Faye Francis
(74) *Attorney, Agent, or Firm* — Frost Brown Todd LLC; Craig J. Cox

(57) ABSTRACT

An industrial shredder is described that includes one or more electric motors controlled by a variable frequency drive. One or more fixed displacement hydraulic pumps are powered by the one or more electric motors and hydraulically coupled to one or more hydraulic motors in a closed loop configuration. Hydraulic pressure in the closed loop is substantially similar on a first side of the one or more hydraulic motors and on a second side of one or more hydraulic motors. One or more cutting shafts are coupled to the one or more hydraulic motors such that the hydraulic motors cause the cutting shafts to rotate.

15 Claims, 10 Drawing Sheets

| Flow (gpm) | Pressure (psi) 500 | 750 | 1000 | 1250 | 1500 | 1750 | 2000 | 2250 | 2500 | 2750 |
|---|---|---|---|---|---|---|---|---|---|---|
| 145 | 42.3 | 63.4 | 84.6 | 105.7 | 126.9 | 148.0 | 169.2 | 190.3 | 211.5 | 232.6 |
| 140 | 40.8 | 61.3 | 81.7 | 102.1 | 122.5 | 142.9 | 163.4 | 183.8 | 204.2 | 224.6 |
| 135 | 39.4 | 59.1 | 78.8 | 98.5 | 118.1 | 137.8 | 157.5 | 177.2 | 196.9 | 216.6 |
| 130 | 37.9 | 56.9 | 75.8 | 94.8 | 113.8 | 132.7 | 151.7 | 170.7 | 189.6 | 208.6 |
| 125 | 36.5 | 54.7 | 72.9 | 91.2 | 109.4 | 127.6 | 145.9 | 164.1 | 182.3 | 200.6 |
| 120 | 35.0 | 52.5 | 70.0 | 87.5 | 105.0 | 122.5 | 140.0 | 157.5 | 175.0 | 192.5 |
| 115 | 33.5 | 50.3 | 67.1 | 83.9 | 100.6 | 117.4 | 134.2 | 151.0 | 167.7 | 184.5 |
| 110 | 32.1 | 48.1 | 64.2 | 80.2 | 96.3 | 112.3 | 128.4 | 144.4 | 160.4 | 176.5 |
| 105 | 30.6 | 45.9 | 61.3 | 76.6 | 91.9 | 107.2 | 122.5 | 137.8 | 153.2 | 168.5 |
| 100 | 29.2 | 43.8 | 58.3 | 72.9 | 87.5 | 102.1 | 116.7 | 131.3 | 145.9 | 160.4 |
| 95 | 27.7 | 41.6 | 55.4 | 69.3 | 83.1 | 97.0 | 110.9 | 124.7 | 138.6 | 152.4 |
| 90 | 26.3 | 39.4 | 52.5 | 65.6 | 78.8 | 91.9 | 105.0 | 118.1 | 131.3 | 144.4 |
| 85 | 24.8 | 37.2 | 49.6 | 62.0 | 74.4 | 86.8 | 99.2 | 111.6 | 124.0 | 136.4 |
| 80 | 23.3 | 35.0 | 46.7 | 58.3 | 70.0 | 81.7 | 93.3 | 105.0 | 116.7 | 128.4 |
| 75 | 21.9 | 32.8 | 43.8 | 54.7 | 65.6 | 76.6 | 87.5 | 98.5 | 109.4 | 120.3 |
| 70 | 20.4 | 30.6 | 40.8 | 51.1 | 61.3 | 71.5 | 81.7 | 91.9 | 102.1 | 112.3 |
| 65 | 19.0 | 28.4 | 37.9 | 47.4 | 56.9 | 66.4 | 75.8 | 85.3 | 94.8 | 104.3 |
| 60 | 17.5 | 26.3 | 35.0 | 43.8 | 52.5 | 61.3 | 70.0 | 78.8 | 87.5 | 96.3 |
| 55 | 16.0 | 24.1 | 32.1 | 40.1 | 48.1 | 56.2 | 64.2 | 72.2 | 80.2 | 88.2 |
| 50 | 14.6 | 21.9 | 29.2 | 36.5 | 43.8 | 51.1 | 58.3 | 65.6 | 72.9 | 80.2 |
| 45 | 13.1 | 19.7 | 26.3 | 32.8 | 39.4 | 45.9 | 52.5 | 59.1 | 65.6 | 72.2 |
| 40 | 11.7 | 17.5 | 23.3 | 29.2 | 35.0 | 40.8 | 46.7 | 52.5 | 58.3 | 64.2 |
| 35 | 10.2 | 15.3 | 20.4 | 25.5 | 30.6 | 35.7 | 40.8 | 45.9 | 51.1 | 56.2 |
| 30 | 8.8 | 13.1 | 17.5 | 21.9 | 26.3 | 30.6 | 35.0 | 39.4 | 43.8 | 48.1 |
| 25 | 7.3 | 10.9 | 14.6 | 18.2 | 21.9 | 25.5 | 29.2 | 32.8 | 36.5 | 40.1 |
| 20 | 5.8 | 8.8 | 11.7 | 14.6 | 17.5 | 20.4 | 23.3 | 26.3 | 29.2 | 32.1 |
| 15 | 4.4 | 6.6 | 8.8 | 10.9 | 13.1 | 15.3 | 17.5 | 19.7 | 21.9 | 24.1 |
| 10 | 2.9 | 4.4 | 5.8 | 7.3 | 8.8 | 10.2 | 11.7 | 13.1 | 14.6 | 16.0 |
| 5 | 1.5 | 2.2 | 2.9 | 3.6 | 4.4 | 5.1 | 5.8 | 6.6 | 7.3 | 8.0 |

FIG. 6A

| 3000 | 3250 | 3500 | 3750 | 4000 | 4250 | 4500 | 4750 | 5000 | 5250 | 5500 |
|---|---|---|---|---|---|---|---|---|---|---|
| 253.8 | 274.9 | 296.1 | 317.2 | 338.4 | 359.5 | 380.7 | 401.8 | 423.0 | 444.1 | 465.3 |
| 245.0 | 265.5 | 285.9 | 306.3 | 326.7 | 347.1 | 367.6 | 388.0 | 408.4 | 428.8 | 449.2 |
| 236.3 | 256.0 | 275.7 | 295.4 | 315.1 | 334.7 | 354.4 | 374.1 | 393.8 | 413.5 | 433.2 |
| 227.5 | 246.5 | 265.5 | 284.4 | 303.4 | 322.3 | 341.3 | 360.3 | 379.2 | 398.2 | 417.2 |
| 218.8 | 237.0 | 255.3 | 273.5 | 291.7 | 309.9 | 328.2 | 346.4 | 364.6 | 382.9 | 401.1 |
| 210.0 | 227.5 | 245.0 | 262.5 | 280.0 | 297.5 | 315.1 | 332.6 | 350.1 | 367.6 | 385.1 |
| 201.3 | 218.1 | 234.8 | 251.6 | 268.4 | 285.2 | 301.9 | 318.7 | 335.5 | 352.2 | 369.0 |
| 192.5 | 208.6 | 224.6 | 240.7 | 256.7 | 272.8 | 288.8 | 304.8 | 320.9 | 336.9 | 353.0 |
| 183.8 | 199.1 | 214.4 | 229.7 | 245.0 | 260.4 | 275.7 | 291.0 | 306.3 | 321.6 | 336.9 |
| 175.0 | 189.6 | 204.2 | 218.8 | 233.4 | 248.0 | 262.5 | 277.1 | 291.7 | 306.3 | 320.9 |
| 166.3 | 180.1 | 194.0 | 207.8 | 221.7 | 235.6 | 249.4 | 263.3 | 277.1 | 291.0 | 304.8 |
| 157.5 | 170.7 | 183.8 | 196.9 | 210.0 | 223.2 | 236.3 | 249.4 | 262.5 | 275.7 | 288.8 |
| 148.8 | 161.2 | 173.6 | 186.0 | 198.4 | 210.8 | 223.2 | 235.6 | 248.0 | 260.4 | 272.8 |
| 140.0 | 151.7 | 163.4 | 175.0 | 186.7 | 198.4 | 210.0 | 221.7 | 233.4 | 245.0 | 256.7 |
| 131.3 | 142.2 | 153.2 | 164.1 | 175.0 | 186.0 | 196.9 | 207.8 | 218.8 | 229.7 | 240.7 |
| 122.5 | 132.7 | 142.9 | 153.2 | 163.4 | 173.6 | 183.8 | 194.0 | 204.2 | 214.4 | 224.6 |
| 113.8 | 123.2 | 132.7 | 142.2 | 151.7 | 161.2 | 170.7 | 180.1 | 189.6 | 199.1 | 208.6 |
| 105.0 | 113.8 | 122.5 | 131.3 | 140.0 | 148.8 | 157.5 | 166.3 | 175.0 | 183.8 | 192.5 |
| 96.3 | 104.3 | 112.3 | 120.3 | 128.4 | 136.4 | 144.4 | 152.4 | 160.4 | 168.5 | 176.5 |
| 87.5 | 94.8 | 102.1 | 109.4 | 116.7 | 124.0 | 131.3 | 138.6 | 145.9 | 153.2 | 160.4 |
| 78.8 | 85.3 | 91.9 | 98.5 | 105.0 | 111.6 | 118.1 | 124.7 | 131.3 | 137.8 | 144.4 |
| 70.0 | 75.8 | 81.7 | 87.5 | 93.3 | 99.2 | 105.0 | 110.9 | 116.7 | 122.5 | 128.4 |
| 61.3 | 66.4 | 71.5 | 76.6 | 81.7 | 86.8 | 91.9 | 97.0 | 102.1 | 107.2 | 112.3 |
| 52.5 | 56.9 | 61.3 | 65.6 | 70.0 | 74.4 | 78.8 | 83.1 | 87.5 | 91.9 | 96.3 |
| 43.8 | 47.4 | 51.1 | 54.7 | 58.3 | 62.0 | 65.6 | 69.3 | 72.9 | 76.6 | 80.2 |
| 35.0 | 37.9 | 40.8 | 43.8 | 46.7 | 49.6 | 52.5 | 55.4 | 58.3 | 61.3 | 64.2 |
| 26.3 | 28.4 | 30.6 | 32.8 | 35.0 | 37.2 | 39.4 | 41.6 | 43.8 | 45.9 | 48.1 |
| 17.5 | 19.0 | 20.4 | 21.9 | 23.3 | 24.8 | 26.3 | 27.7 | 29.2 | 30.6 | 32.1 |
| 8.8 | 9.5 | 10.2 | 10.9 | 11.7 | 12.4 | 13.1 | 13.9 | 14.6 | 15.3 | 16.0 |

FIG. 6B

INDUSTRIAL SHREDDER

TECHNICAL FIELD

The present disclosure is generally directed to an industrial shredder, specifically an industrial shredder with a closed loop hydraulic motor and variable frequency drive (VFD) controller.

BACKGROUND OF THE INVENTION

A shredder may be used to cut or tear larger objects into smaller objects. Shredding may be useful in recycling materials, or compacting them prior to disposing of them. A shredder is typically made up of a shaft with cutting surfaces used to cut materials placed into the shredder. The shaft of a shredder may be driven by various types of motors, for example, electric or hydraulic motors may be used.

FIG. 1 is a diagram of an embodiment of an electric drive shredder 100. The electric drive shredder 100 comprises two electric motors 110. The electric motors 110 are connected to a clutch mechanism 120, which may be a friction clutch. The clutch mechanism 120 acts as a guard coupling for the electric motors 110. The clutch mechanism 120 is connected to a 2-stage planetary gear drive 130 that is used to turn a shaft at a lower rpm than the rpm provided by the electric motors 110, for example, turning the shaft at 26 rpm where the electric motor is running at 1800 rpm. The gear drive 130 may be connected to a shaft (not pictured), which includes a plurality of cutting surfaces 140 used to shred materials. As described, the electric motors 110 may be configured to run at an efficient or desired speed for the particular electric motor. In the example of FIG. 1, the motor is configured to run at 1800 rpm. The electric motors 110 may also be rated for an output power based on the application. An example of a typical electric motor would operate at 150 horse-power (HP) using 3 phase 460 volt alternating current (VAC).

FIG. 2 is a diagram of an embodiment of a typical open loop hydraulic drive shredder 200. The hydraulic drive shredder 200 uses two hydraulic motors 210. The hydraulic motors 210 are powered by a hydraulic power unit 300 as depicted in FIG. 3. The hydraulic motors 210 can be configured to operate at a desired or efficient speed, such as 50 rpm. The hydraulic motors 210 are coupled to a gear box 220. The gear box 220 is used to turn a shaft powering the cutting surfaces at a lower rpm than the rpm provided by the hydraulic motors 210. For example, the gear box 220 may receive 50 rpm and output 26 rpm. The gear box 220 is typically connected to a shaft that includes a plurality of cutting surfaces used to shred materials.

FIG. 3 is a diagram of an embodiment of a hydraulic power unit 300. The hydraulic power unit 300 includes a hydraulic fluid reservoir 310, three fixed speed electric motors 320 coupled to fixed displacement pumps 330 and two hydraulic fluid coolers 340. The hydraulic power unit 300 is used to power the hydraulic motors 210 on the hydraulic drive shredder 200. The system comprising the hydraulic drive shredder 200 and the hydraulic power unit 300 may be referred to as an open loop hydraulic system.

In an open loop hydraulic system, the inlet to the pump and the return from the hydraulic motor are connected to the hydraulic fluid reservoir. The pump provides a continuous flow of hydraulic fluid to the hydraulic motors. The open loop hydraulic system typically uses less expensive constant displacement pumps.

Open loop hydraulic drive shredders provide several advantages over electric drive shredders. First, the open loop hydraulic drive shredder may be more durable than an electric drive shredder, typically hydraulic motors and pumps have a longer service life than that of the electric motors in the electric drive shredder. Second, the open loop hydraulic drive shredder may provide increased shock load protection. For example, if the shredder experiences a sudden load increase, as from the cutting shaft being stopped quickly from a jam condition, energy may be released through hydraulic fluid into the hydraulic fluid reservoir, in an electric drive system energy may be released at the clutch or may be returned to the electric motor, causing damage to drive components. Third, the open loop hydraulic drive shredder allows for a faster reversal of the direction of the hydraulic motors. Because the energy in the system can be returned to the hydraulic reservoir, the hydraulic motor may stop faster and therefore reverse faster than an electric motor which must slow down and release energy in the system by friction braking. Reversal of the motor is useful when a jam occurs in the shredder, reversing the direction of the shredder shafts allows the material causing the jam to be cleared and normal operations to continue. Lastly, all drive train parts in an open loop hydraulic drive shredder are continuously cleaned and cooled. The hydraulic fluid in the system is continuously pumped through the system and thus lubricates the parts of the drive train. In addition, the hydraulic fluid is continuously flowed through the hydraulic fluid coolers allowing heat generated in the system to dissipate into the atmosphere.

Electric drive shredders provide several advantages over open loop hydraulic drive shredders. First, electric drive shredders offer a smaller package size than the open loop hydraulic drive shredder, for example, the electric drive shredders do not require the hydraulic power unit, thus the footprint of the hydraulic reservoir and hydraulic fluid coolers would not be necessary for an electric drive system. Second, electric drive shredders offer a reduced chance of fluid leaks because of the reduction in hydraulic fluid used by the system. Third, electric drive shredders provide a lower noise solution relative to open loop hydraulic drive shredders. The electric drive shredder typically requires fewer motors than the open loop hydraulic drive shredders and is therefore quieter. Because the electric drive shredder typically requires fewer motors than the open loop hydraulic drive shredders, it is usually more energy efficient.

It would be desirable to design an industrial shredder that realizes the advantages of both electric drive shredders and open loop hydraulic shredders.

BRIEF SUMMARY OF THE INVENTION

In a preferred embodiment, an industrial shredder is described that includes one or more electric motors controlled by a variable frequency drive. One or more fixed displacement hydraulic pumps are powered by the one or more electric motors and hydraulically coupled to one or more hydraulic motors in a closed loop configuration. Hydraulic pressure in the closed loop is substantially similar on a first side of the one or more hydraulic motors and on a second side of one or more hydraulic motors. One or more cutting shafts are coupled to the one or more hydraulic motors such that the hydraulic motors cause the cutting shafts to rotate.

In another embodiment a closed loop hydraulic shredder is described that includes one or more hydraulic pumps powering one or more hydraulic motors. One or more cutting shafts are turned by the one or more hydraulic motors. A Variable Frequency Drive (VFD) is configured to monitor operating characteristics of the closed loop hydraulic shredder and vary power characteristics to maintain a pre-determined operating horsepower.

In yet another embodiment a method for cutting shaft reversal in an industrial shredder is described. The method includes operating a fixed displacement hydraulic pump shaft in a first direction and causing a hydraulic motor and cutting shaft to rotate in the first direction by the operation of the fixed displacement hydraulic pump. A need to reverse direction of the cutting shaft is determined and the fixed displacement hydraulic pump shaft is then operated in a second direction, the second direction opposite of the first direction thereby causing the hydraulic motor and cutting shaft to rotate in the second direction.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 6A is a partial view of a chart of the relationship of flow to pressure at certain horsepower;

FIG. 6B is a partial view of a chart of the relationship of flow to pressure at certain horsepower.

DETAILED DESCRIPTION OF THE INVENTION

Described herein are embodiments of an industrial shredder that combines the benefits of electric and hydraulic shredders. The shredder is driven by a closed loop hydraulic system controlled by a variable frequency drive (VFD). Use of a closed loop hydraulic system allows for additional safety features to be applied to the shredder, for example an instantaneous emergency stop.

In contrast to the open loop hydraulic system described above, in a closed loop hydraulic system, the outlet of the hydraulic motor returns directly to the inlet of the pump without an intervening hydraulic fluid reservoir. A small reservoir may be connected to a side channel of the system for cooling and filtering the hydraulic fluid in the system, however, in preferred embodiments the vast majority of the hydraulic fluid remains pressurized in the main loop.

Figure 1:
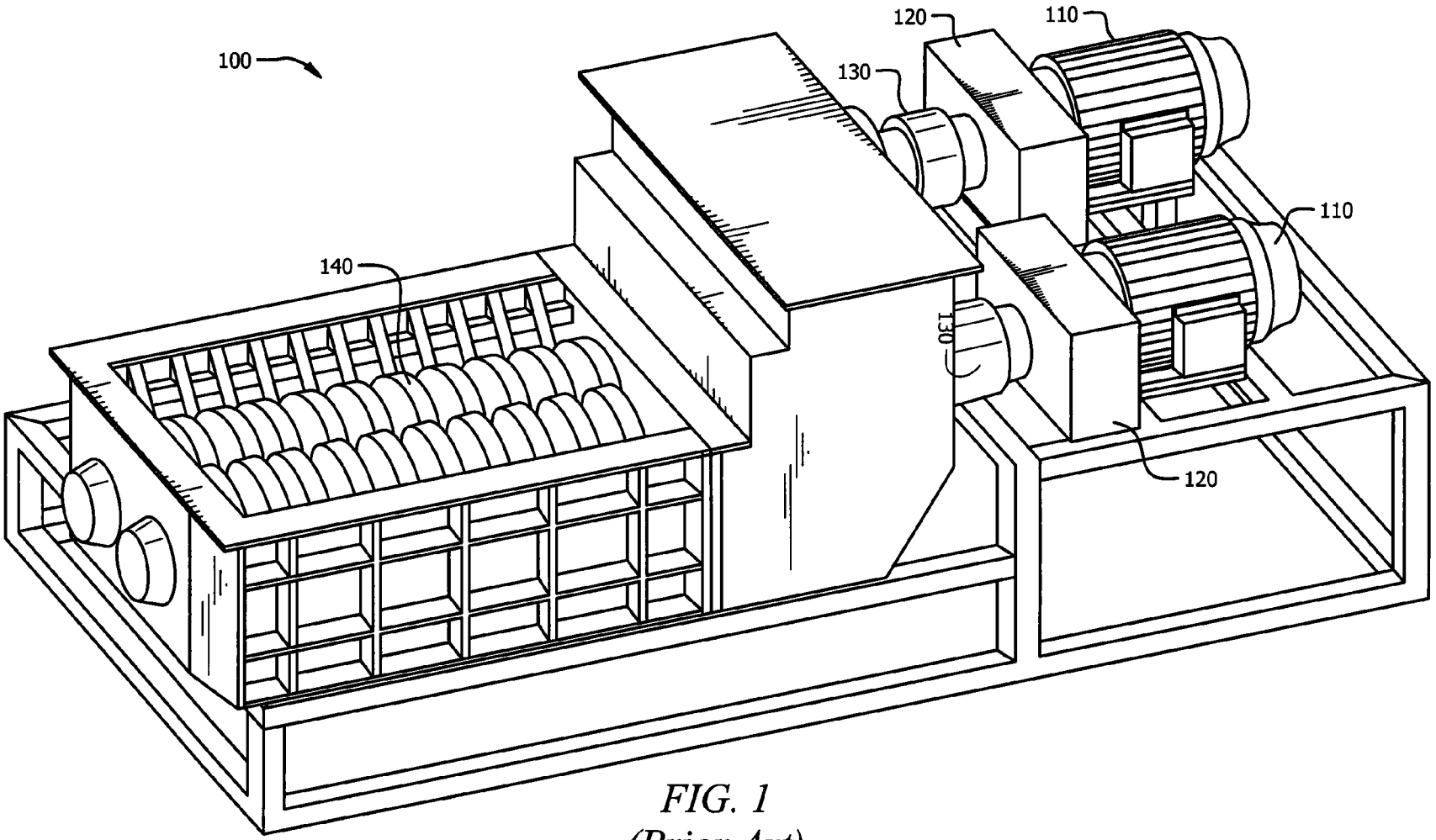
FIG. 1 (Prior Art)
FIG. 1 is a diagram of an embodiment of an electric drive shredder.
Figure 2:
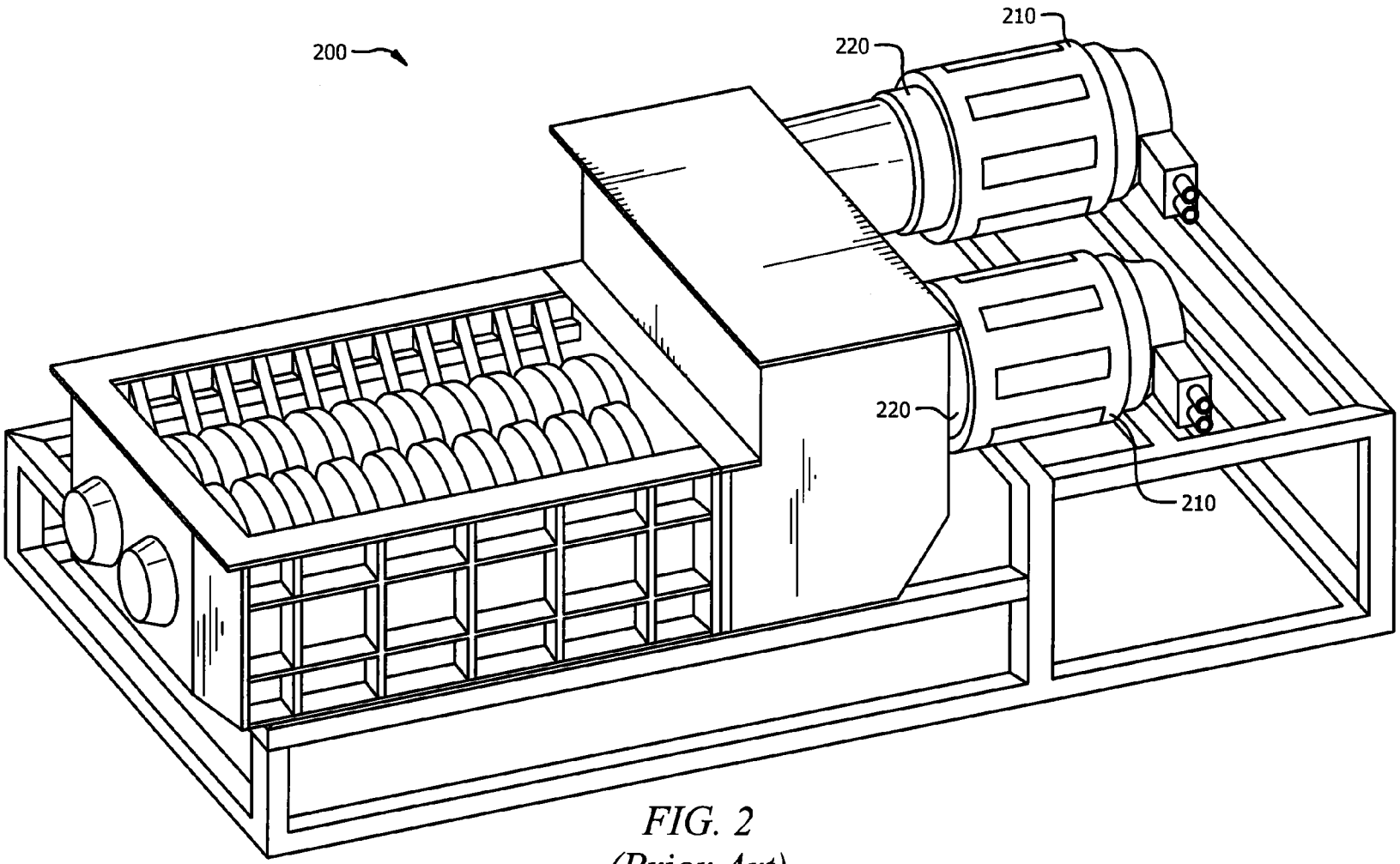
FIG. 2 (Prior Art)
FIG. 2 is a diagram of an embodiment of a hydraulic drive shredder.
Figure 3:
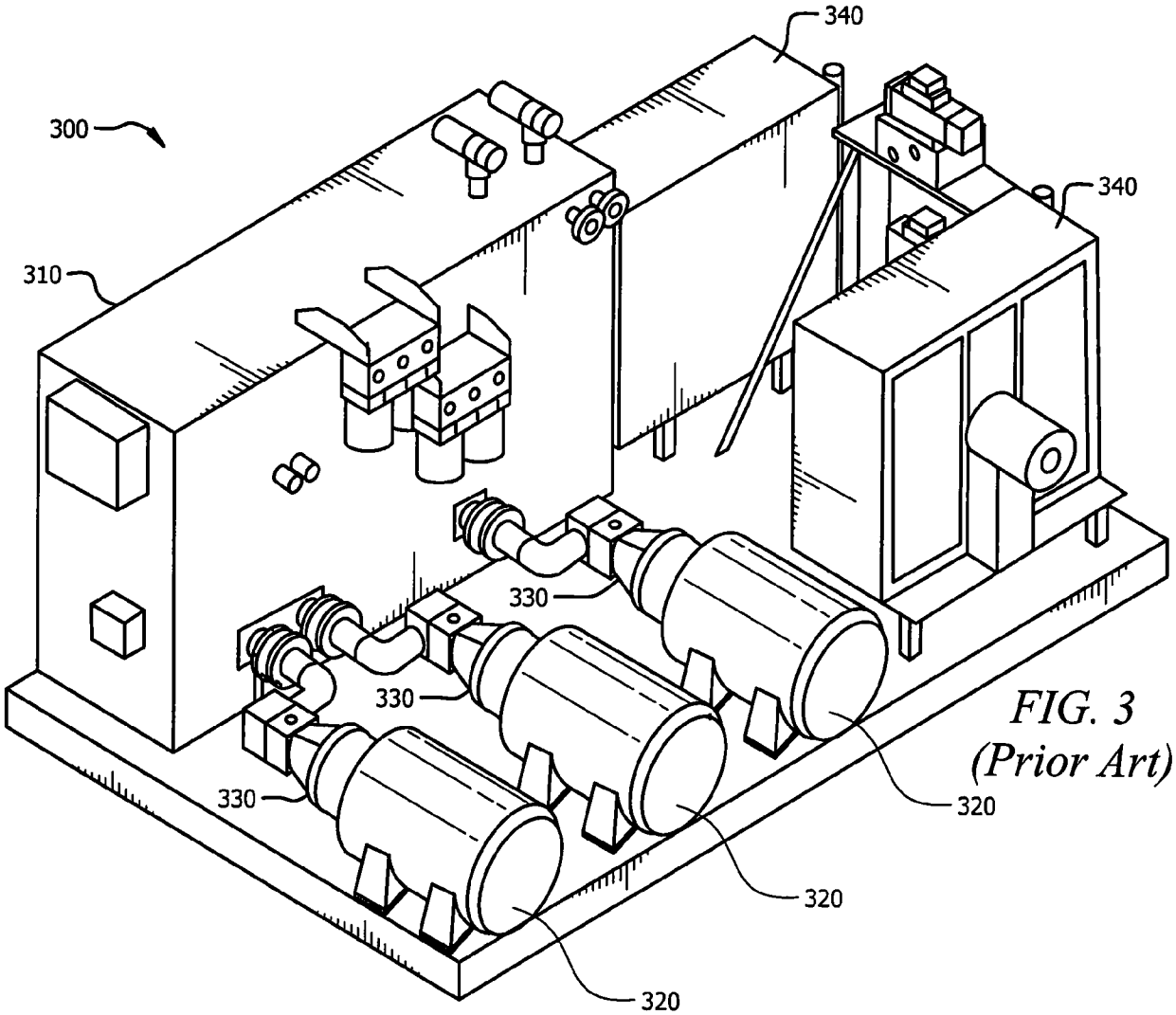
FIG. 3 (Prior Art)
FIG. 3 is a diagram of an embodiment of a hydraulic power unit.
Figure 4:
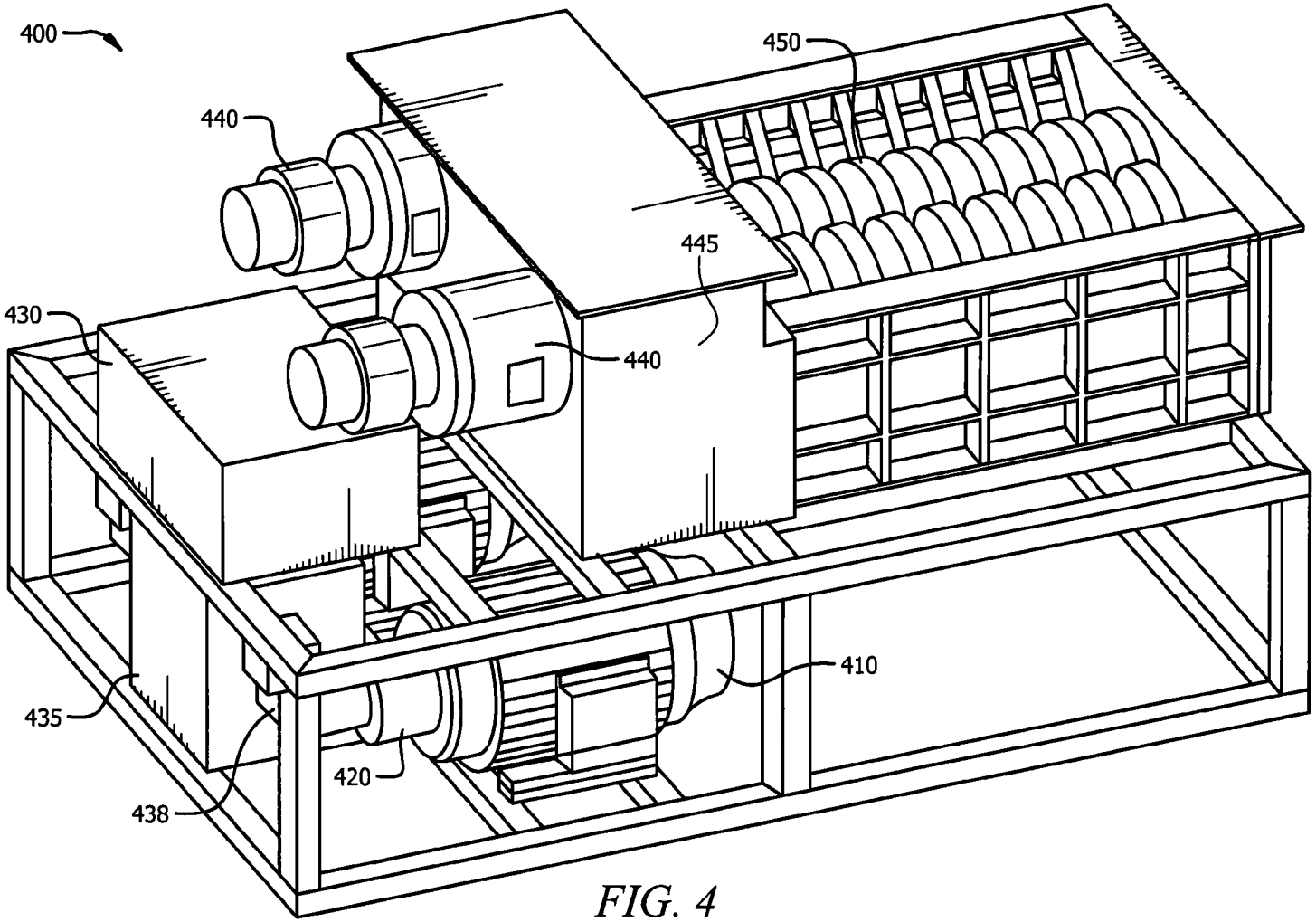
FIG. 4 is a diagram of an embodiment of a closed loop hydraulic drive shredder.

FIG. 4 is a diagram of an embodiment of a closed loop hydraulic drive shredder 400. The closed loop hydraulic drive shredder 400 may comprise two electric motors 410 coupled to hydraulic pumps 420. The hydraulic pumps 420 may be coupled to manifold 438. The manifold 438 may be coupled to hydraulic motors 440. The hydraulic motors 440 may be coupled to cutting shafts 450 either with or without an intermediate gearbox in between. Manifold 438 may contain a pre-charge pump, a variable relief valve, a hot oil shuttle valve, check valves, a hydraulic oil reservoir 430, a kidney loop pump, a filter, a heat exchanger 435, or other required hydraulic components for proper system operation. While a certain number of cutting shafts 450; hydraulic motors 440; hydraulic pumps 420; and electric motors 410 are shown, any number of cutting shafts 450; hydraulic motors 440; hydraulic pumps 420; and electric motors 410 may be selected and used based upon the desired operating characteristics of the closed loop hydraulic drive shredder 400.

Figure 5A:
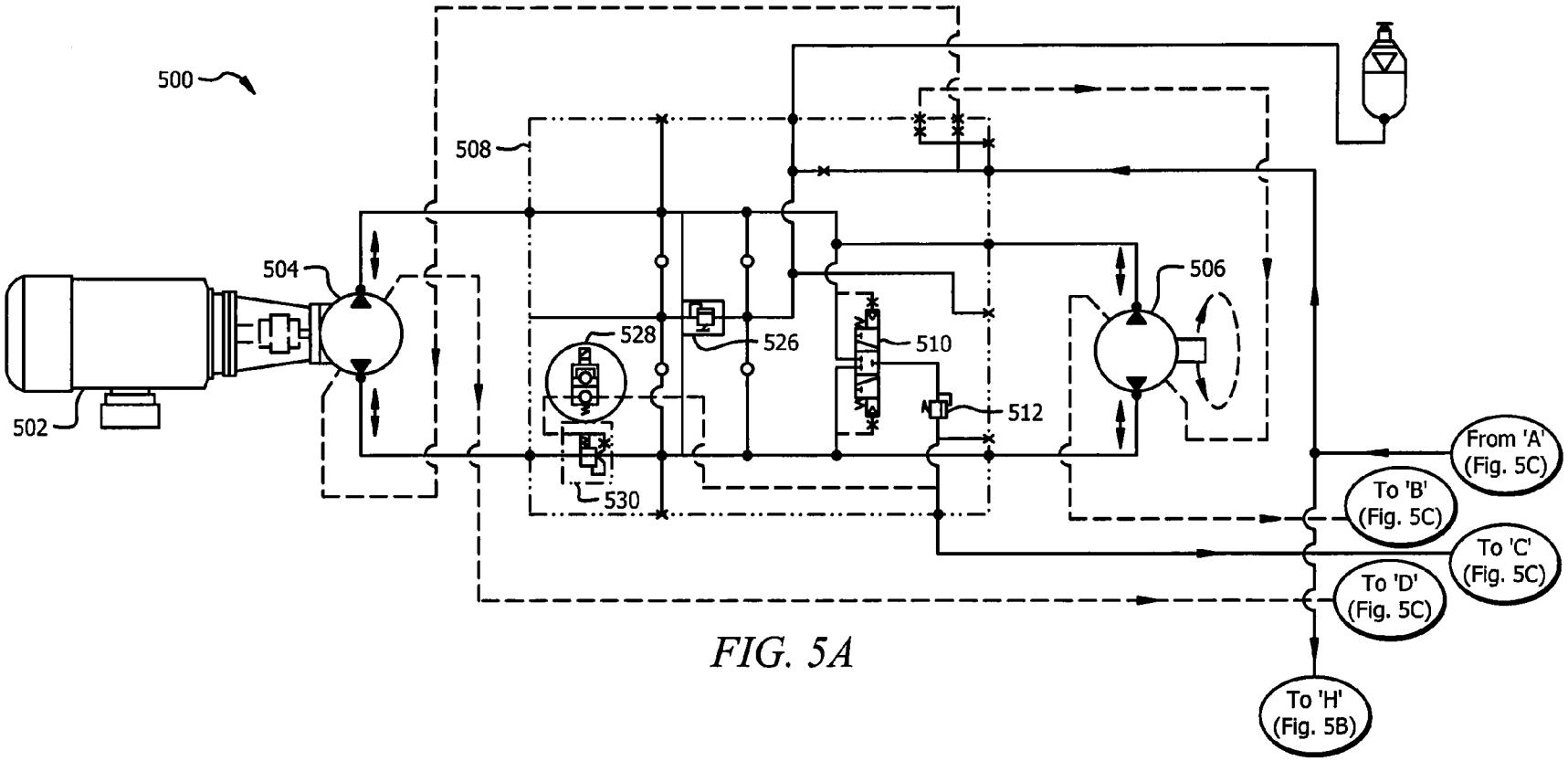
FIG. 5A is a partial view of a hydraulic schematic of an embodiment of a closed loop hydraulic drive system.
Figure 5B:
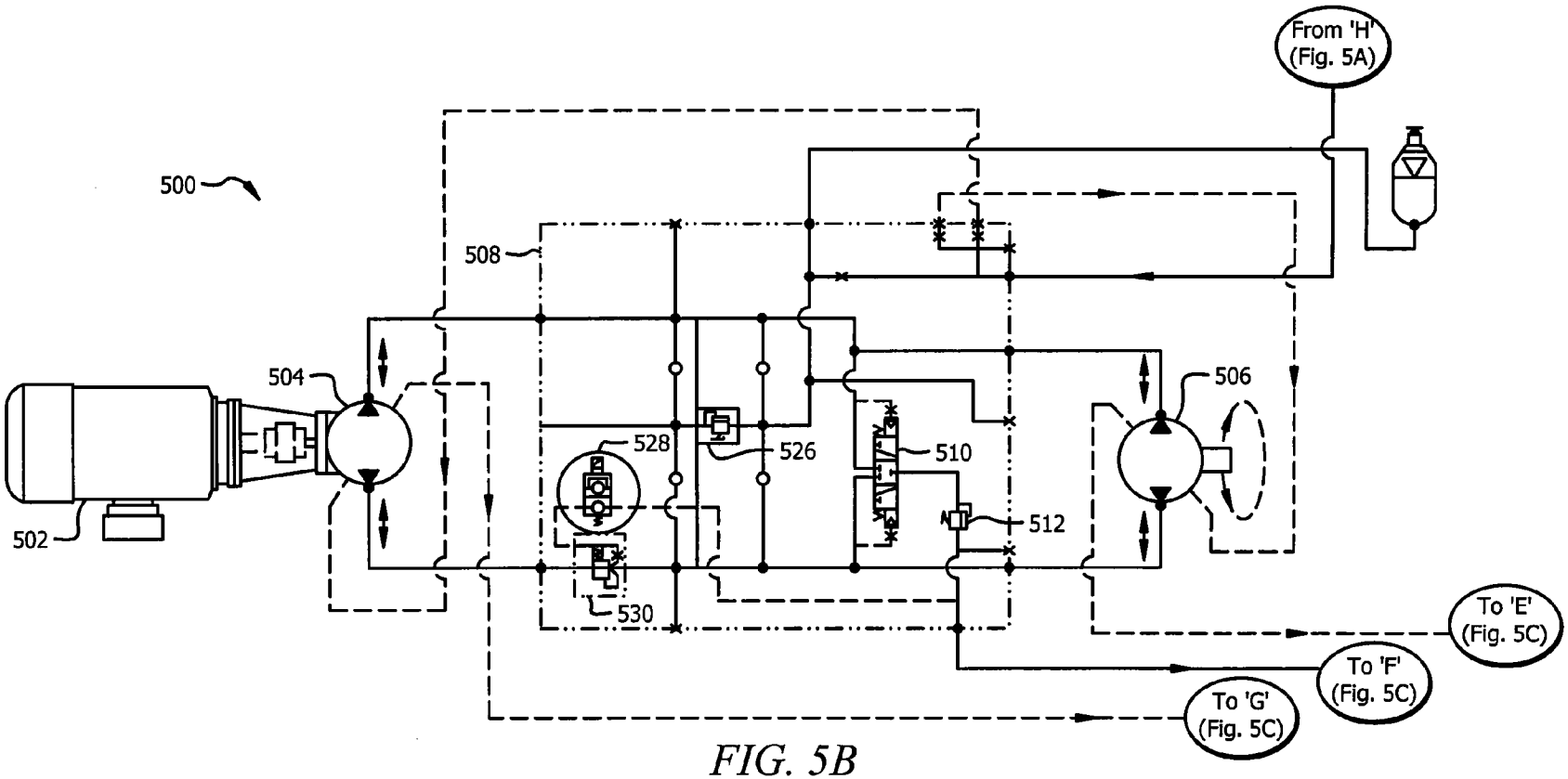
FIG. 5B is a partial view of a hydraulic schematic of an embodiment of a closed loop hydraulic drive system.
Figure 5C:
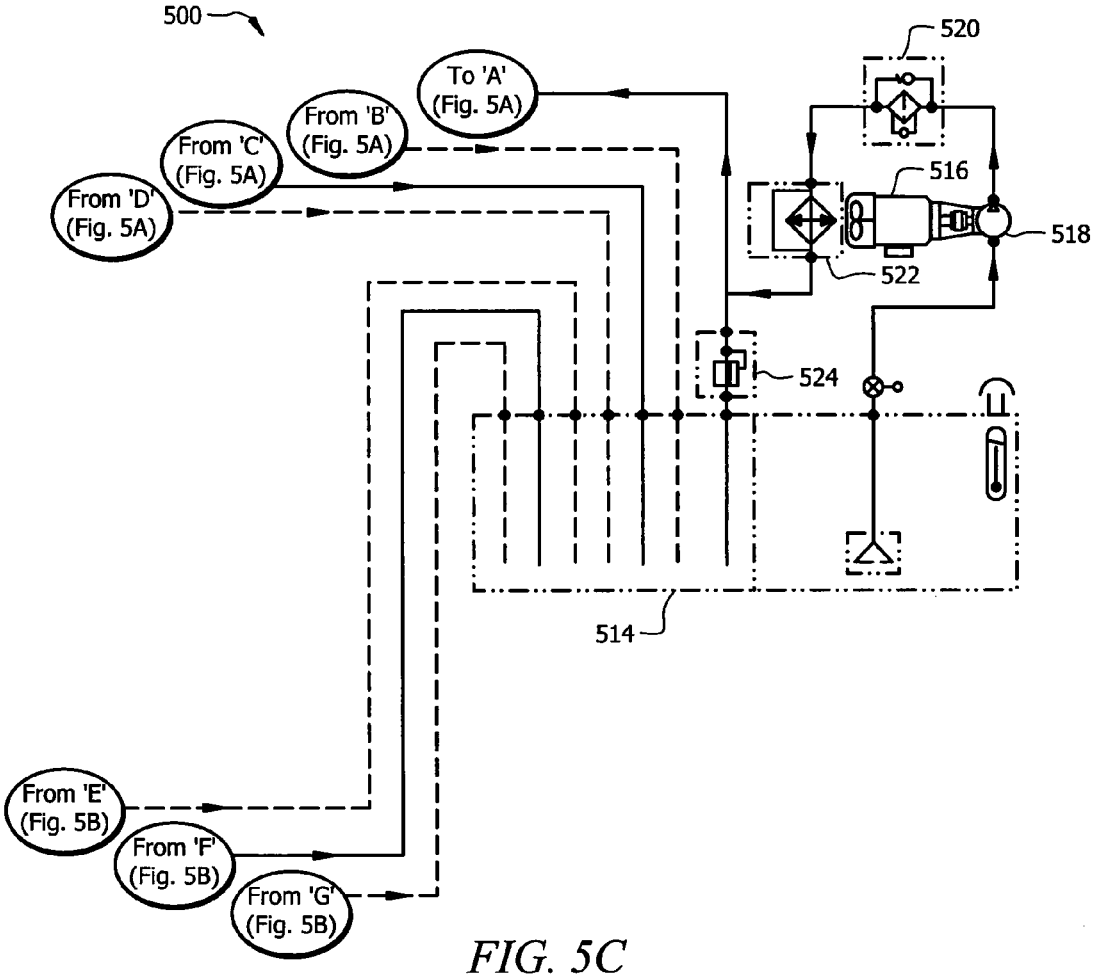
FIG. 5C is a partial view of a hydraulic schematic of an embodiment of a closed loop hydraulic drive system.

FIGS. 5A, 5B, and 5C are a hydraulic schematic of a preferred embodiment of a closed loop hydraulic drive system 500. Electric motor 502 is coupled to hydraulic pump 504. For particular applications, such as shredding of tires and similar materials, electric motor 502 may be normally configured to generate at 125 HP at 1800 RPM. Electric motor 502 is controlled by a VFD configured to vary power provided to the electric motor 502 based upon the load characteristics experienced by the loop hydraulic drive system 500. Hydraulic pump 504 is coupled to hydraulic motor 506 via hydraulic lines. Hydraulic manifold 508 preferably includes hot oil shuttle valve 510 which is used to remove oil from the closed loop system to reservoir 514 for cooling and filtering. Hot oil shuttle valve 510 may be configured to divert 15-20%, or any other desired amount, of the hydraulic oil in the closed loop to a side channel that includes a heat exchanger and a filter mechanism. Pressure relief valve 512 may be placed inline between the hot oil shuttle valve 510 and the reservoir 514. Pressure relief valve 512 is preferrably a normally closed valve that opens when a predefined pressure threshold is reached at a pilot line. In typical embodiments, the predefined threshold may be on the order of 150 psi.

Side channel motor 516 may be a 5 HP motor with an operating speed of 1800 rpm. Side channel motor 516 powers side channel pump 518, which pumps hydraulic oil from reservoir 514 to cooler 522. Once the hydraulic fluid is filtered at filter 520 it may enter heat exchanger, such as filter 520 to release heat generated in the system. From cooler 522, the hydraulic oil is returned to the closed loop, or if pressure in the closed loop is greater than a predetermined threshold, the hydraulic oil may be returned to reservoir 514 through pressure control valve 524. In preferred embodiments, the predetermined threshold may be set to 250 psi.

Hydraulic manifold 508 may also contain a high pressure relief valve 526. Jam pressure relief valve 508 may be a normally closed valve that opens when a predefined pressure threshold is reached in the closed loop system. In this embodiment a predefined threshold pressure of 6000 psi is selected. When a jam occurs in the shredder, the pressure in the closed loop system may continue to build because the electric motor 502 continues to pump hydraulic oil. If and when the pressure in the closed loop system reaches 6000 psi, jam pressure release valve 526 opens and passes hydraulic oil from the high pressure side of the loop to the low pressure side of the loop, thus dissipating energy from the closed loop system. This pressure relief mechanism prevents undue strain on the electric motor and hydraulic pumps by providing a relief mechanism for energy trapped in the hydraulic system during a jam. In electric shredders, the energy in the system is dissipated in the clutch mechanisms or in the electric motor or gearbox itself, potentially damaging those pieces of equipment.

In certain embodiments, hydraulic manifold 508 may contain an emergency stop mechanism. The emergency stop mechanism may include a directional control valve 528 and a 2 position logic valve 530. The directional control valve is a normally closed valve, thus under normal operation (with the 528 valve solenoid energized), sufficient pressure is maintained on the logic valve 530 to allow hydraulic oil to flow though hydraulic pump 504 to hydraulic motor 506. If an emergency stop button (not pictured) is depressed, the directional control valve 528 closes and blocks hydraulic oil from draining to reservoir 514. When this happens, pressure in the spring chamber of the logic valve 530 builds and forces the logic valve closed, stopping flow of hydraulic oil in the closed loop and consequently halting revolution of the hydraulic motor 506. This action can occur very quickly, allowing the shafts and cutting blades to stop completely in a fraction of a second or a few seconds depending on the application and configuration of the shredder.

Hydraulic pumps 420 are preferably powered by a VFD. The VFD may be configured to receive 3 phase AC, convert the 3 phase AC to DC and then convert the DC to a variable AC output. The variable AC output is used to drive hydraulic pumps 420. In an embodiment the VFD outputs full load amperage at 90 HZ, as the load increases, the frequency decreases in order to maintain a similar horsepower at the hydraulic pumps 420. The relationship of frequency and amps to determine horsepower may also be represented as pressure in psi vs flow in gpm. FIGS. 6A and 6B are a chart of the relationship of flow to pressure at certain horsepower. An ideal or preferred operating horsepower is selected, for certain embodiments a preferred horsepower may be approximately 150 horsepower. For example, FIG. 6A shows that when the closed loop pressure is 1750 psi, the flow rate may be set to 145 gallons per minute (gpm) to maintain 148 horsepower. Therefore, as pressure in the system increases, flow may be reduced in order to maintain the preferred operating horsepower. By maintaining operating horsepower at the preferred horsepower for the system, the efficiency of the system may be significantly increased. The increase in efficiency can be attributed to the avoidance of large spikes in horsepower (and therefore current drawn). While certain precise values are shown in FIGS. 6A and 6B, it should be understood that the values may vary based upon the chosen specification for and tolerances of the operating equipment and measurement equipment. In any case, the VFD may detect changes in system characteristics and make changes to its output in order to maintain a certain horsepower, thereby increasing the overall efficiency of the system. Likewise, the VFD provides efficiencies at startup of the system. In some instances customers may be charged for power based upon the largest spike during operations. Rather than experience the large inrush current that is typical with most constant drive electric motors, the VFD may gradually apply power during start up to avoid a large spike of inrush current, thereby increasing efficiency of the system and reducing costs.

The closed loop hydraulic system described herein may reverse direction of the cutting blades by reversing the rotation hydraulic pump shaft. When a jam or other overload condition is detected at the cutting blades, it may be desirable to reverse direction of the cutting blades. In some shredders, changing cutting blade direction requires changing the direction of flow of the hydraulic fluid in the system. In some cases, reversal of direction of fluid flow may be achieved using a directional control valve or switching valve. Thus a mechanical component may be required in some hydraulic systems in order to change direction of flow. In some cases, a variable volume, closed loop, hydraulic pump may be used without a directional valve and can reverse shafts without changing the direction or speed of pump shaft rotation. The closed loop hydraulic system described herein may reverse direction of the cutting blades without the use of a directional control valve or switching valve or without a variable volume hydraulic pump. The closed loop hydraulic system described herein may reverse the direction of the cutting blades by reversing the direction of the rotation of the hydraulic pump. By changing the direction of flow at the pump, the direction of rotation at the hydraulic motor is also changed, resulting in a reversal of direction of the cutting blades.

Figure 7:
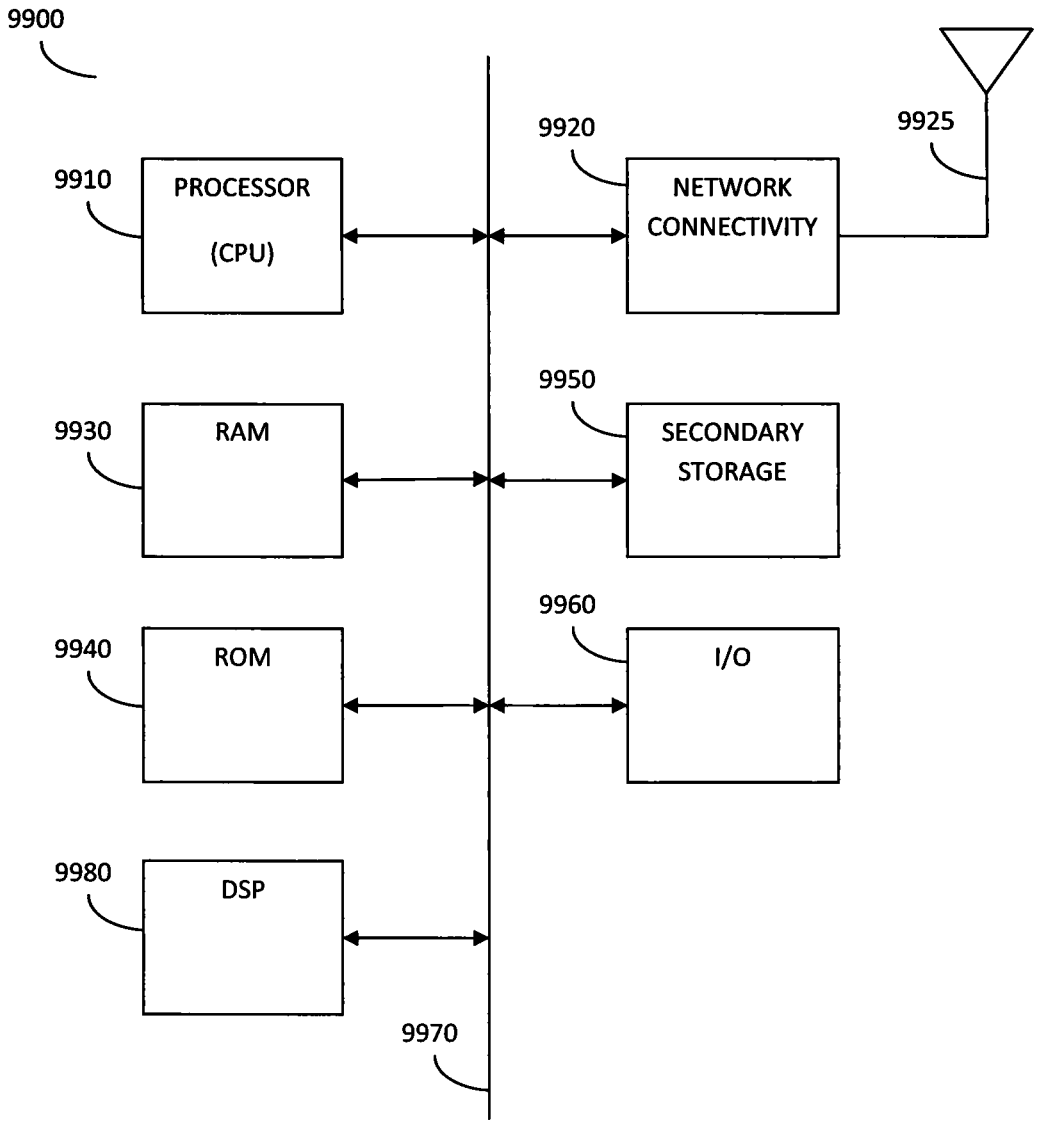
FIG. 7 is a block diagram of a processing system.

FIG. 7 illustrates an example of a system 9900 that includes a processor 9910 suitable for implementing one or more embodiments disclosed herein. The processor 9910 may control the overall operation of the device.

In addition to the processor 9910 (which may be referred to as a central processor unit or CPU), the system 9900 might include network connectivity devices 9920, random access memory (RAM) 9930, read only memory (ROM) 9940, secondary storage 9950, and input/output (I/O) devices 9960. These components might communicate with one another via a bus 9970. In some cases, some of these components may not be present or may be combined in various combinations with one another or with other components not shown. These components might be located in a single physical entity or in more than one physical entity. Any actions described herein as being taken by the processor 9910 might be taken by the processor 9910 alone or by the processor 9910 in conjunction with one or more components shown or not shown in the drawing, such as a digital signal processor (DSP) 9980. Although the DSP 9980 is shown as a separate component, the DSP 9980 might be incorporated into the processor 9910.

The processor 9910 executes instructions, codes, computer programs, or scripts that it might access from the network connectivity devices 9920, RAM 9930, ROM 9940, or secondary storage 9950 (which might include various disk-based systems such as hard disk, floppy disk, or optical disk). While only one CPU 9910 is shown, multiple processors may be present. Thus, while instructions may be discussed as being executed by a processor, the instructions may be executed simultaneously, serially, or otherwise by one or multiple processors. The processor 9910 may be implemented as one or more CPU chips and may be a hardware device capable of executing computer instructions.

The network connectivity devices 9920 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, universal mobile telecommunications system (UMTS) radio transceiver devices, long term evolution (LTE) radio transceiver devices, worldwide interoperability for microwave access (WiMAX) devices, and/or other well-known devices for connecting to networks. These network connectivity devices 9920 may enable the processor 9910 to communicate with the Internet or one or more telecommunications networks or other networks from which the processor 9910 might receive information or to which the processor 9910 might output information. The network connectivity devices 9920 might also include one or more transceiver components 9925 capable of transmitting and/or receiving data wirelessly.

The RAM 9930 might be used to store volatile data and perhaps to store instructions that are executed by the processor 9910. The ROM 9940 is a non-volatile memory device that typically has a smaller memory capacity than the memory capacity of the secondary storage 9950. ROM 9940 might be used to store instructions and perhaps data that are read during execution of the instructions. Access to both RAM 9930 and ROM 9940 is typically faster than to secondary storage 9950. The secondary storage 9950 is typically comprised of one or more disk drives or tape drives and might be used for non-volatile storage of data or as an over-flow data storage device if RAM 9930 is not large enough to hold all working data. Secondary storage 9950 may be used to store programs that are loaded into RAM 9930 when such programs are selected for execution.

The I/O devices 9960 may include liquid crystal displays (LCDs), touch screen displays, keyboards, keypads, switches, dials, mice, track balls, voice recognizers, card readers, paper tape readers, printers, video monitors, or other well-known input/output devices. Also, the transceiver 9925 might be considered to be a component of the I/O devices 9960 instead of or in addition to being a component of the network connectivity devices 9920.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An industrial shredder comprising:

one or more electric motors;

one or more fixed displacement hydraulic pumps powered by the one or more electric motors;

one or more hydraulic motors coupled to the one or more hydraulic pumps in a closed loop configuration, wherein hydraulic pressure in the closed loop is substantially similar on a first side of the one or more hydraulic motors and on a second side of one or more hydraulic motors;

one or more cutting shafts coupled to the one or more hydraulic motors; and an emergency stop mechanism, the emergency stop mechanism comprising;

a logic valve coupled to a flow of hydraulic oil between the one or more hydraulic pumps and the one or more hydraulic motors; and a directional control valve;

wherein the direction of a cutting shaft is reversed by operating the one or more hydraulic pumps in a direction opposite of an original direction of rotation and wherein when the directional control valve is closed it blocks hydraulic oil from draining to a reservoir, causing the logic valve to close and stop the flow of hydraulic oil in the closed loop.

2. The shredder of claim 1 further comprising an intermediate gearbox between the one or more cutting shafts and the one or more hydraulic motors.

3. The shredder of claim 1 wherein the shredder comprises two hydraulic pumps and two hydraulic motors.

4. The shredder of claim 1 wherein the shredder comprises two cutting shafts.

5. The shredder of claim 1 further comprising a variable frequency drive controller controlling the electric motors.

6. The shredder of claim 1 wherein a variable frequency drive is configured to monitor operating characteristics of the closed loop hydraulic shredder and vary power characteristics to maintain a pre-determined operating horsepower.

7. The shredder of claim 1 wherein a controller measures the input power to the one or more electric motors to determine whether to reverse direction of the cutting shaft.

8. The shredder of claim 7 wherein the direction of the cutting shaft is reversed without the use of a directional control valve, switching valve, or variable volume hydraulic pump.

9. A closed loop hydraulic shredder comprising:

one or more hydraulic pumps;

one or more hydraulic motors powered by the one or more hydraulic pumps;

one or more cutting shafts turned by the one or more hydraulic motors;

a Variable Frequency Drive (VFD), the VFD configured to monitor operating characteristics of the closed loop hydraulic shredder and vary power characteristics to maintain a pre-determined operating horsepower; and an emergency stop mechanism, the emergency stop mechanism comprising;

a logic valve coupled to a flow of hydraulic oil between the one or more hydraulic pumps and the one or more hydraulic motors; and a directional control valve;

wherein the direction of the one or more cutting shafts is reversed by operating the one or more hydraulic pumps in a direction opposite of an original direction of rotation and wherein when the directional control valve is closed it blocks hydraulic oil from draining to a reservoir, causing the logic valve to close and stop the flow of hydraulic oil in the closed loop.

10. The shredder of claim 9 further comprising an intermediate gearbox between the one or more cutting shafts and the one or more hydraulic motors.

11. The shredder of claim 9 wherein the shredder comprises two hydraulic pumps and two hydraulic motors.

12. The shredder of claim 9 wherein the shredder comprises two cutting shafts.

13. The shredder of claim 9 wherein the one or more hydraulic motors are connected to the one or more hydraulic pumps in a closed loop configuration.

14. The shredder of claim 13 wherein hydraulic pressure in the closed loop is substantially similar on a first side of the one or more hydraulic motors and on a second side of one or more hydraulic motors.

15. A closed loop hydraulic shredder comprising:

one or more hydraulic pumps;

one or more hydraulic motors powered by the one or more hydraulic pumps;

one or more cutting shafts turned by the one or more hydraulic motors;

an emergency stop mechanism, the emergency stop mechanism comprising;

a logic valve coupled to a flow of hydraulic oil between the one or more hydraulic pumps and the one or more hydraulic motors; and a directional control valve;

wherein when the directional control valve is closed it blocks hydraulic oil from draining to a reservoir, causing the logic valve to close and stop the flow of hydraulic oil in the closed loop.

* * * * *